US005292386A

United States Patent [19]

Schelb et al.

[11] Patent Number: 5,292,386

[45] Date of Patent: Mar. 8, 1994

[54] PROCESS FOR THE MANUFACTURE OF ALUMINUM SHEETS

[75] Inventors: Werner Schelb, Ransbach-Baumbach; Manfred Peters, Bad Honnef-Rhöndorf; Karl Welpmann, Köln, all of Fed. Rep. of Germany

[73] Assignees: Hoogovens Aluminium GmbH, Dusseldorf; Duetsche Forschungsanstalt fur Luft und Raumfahrt DLR, Cologne, both of Fed. Rep. of Germany

[21] Appl. No.: 870,656

[22] Filed: Apr. 22, 1992

[30] Foreign Application Priority Data

Apr. 24, 1991 [DE] Fed. Rep. of Germany ..... 4113352

[51] Int. Cl.[5] ..... C22F 1/04

[52] U.S. Cl. ..... 148/691; 148/692; 148/693; 148/694; 148/697; 148/698; 148/415; 148/437

[58] Field of Search ..... 148/691, 692, 693, 694, 148/697, 698, 415, 437

[56] References Cited

U.S. PATENT DOCUMENTS 4,961,792 10/1990 Rioja et al. ..... 148/692

*Primary Examiner*—R. Dean
*Assistant Examiner*—Robert R. Koehler
*Attorney, Agent, or Firm*—Hopgood, Calimafde, Kalil, Blaustein & Judlowe

[57] ABSTRACT

In order to achieve damage-tolerant properties and sufficient isotropy of aluminum alloys, particularly of type AlLi 8090, subsequent especially to hot-forming of a bar of said aluminum alloy there is interposed a solution heat treatment and quenching, followed by working and subsequent intermediate annealing within a temperature range of from 250° to 475° C. for a period of from 1 to 85 hours. The intermediate annealing is followed by cold forming and subsequent solution heat treatment with the additional purpose of recrystallization, whereupon the recrystallized material is especially cold-formed to a degree of deformation of only up to 8%. Thereafter the sheets having a sheet thickness of from 0.5 to 10 mm are subjected to artificial aging.

8 Claims, 1 Drawing Sheet

AG 80%X0 TO(111)
LEVELS: MAX:
1-2-4-6 6,5

TO LEVELS: 1-2-4-7 TO (111) MAX: 7,4

TO LEVELS: 1-2-4 TO(111) MAX: 4,2

AG 80%X0 LEVELS: 1-2-4-6 TO(111) MAX: 6,5

AG 80%XT5 LEVELS: 1-2-3 TO(111) MAX: 3,4

PROCESS FOR THE MANUFACTURE OF ALUMINUM SHEETS

The invention is directed to a process for the manufacture of sheets or plates from aluminium alloys.

In the case of aluminium-lithium alloys, which are mainly used for structurally critical aerospace components, it is desirable for achieving adequate damage-tolerant properties and sufficient isotropy that the material should be recrystallized prior to the artificial aging stage when sheets or plates of a thickness of approximately 1 to 8 mm are rolled. It is unfortunate that normally, anisotropic mechanical properties result as compared with type 2024 T 351 aluminium alloys. In crack propagation tests, sheets made from the last-mentioned aluminium alloy exhibit fatigue cracks which extend macroscopically normal to the direction of the applied principal normal stress, which fact can be utilized for example in the construction of aircraft components.

It has been found, however, that in the case of aluminium-lithium alloys such a desirable material behaviour cannot be obtained by cold working and subsequent recrystallization prior to artificial aging, not even if the recrystallization process is promoted by conducting a conventional thermal treatment subsequent to hot rolling and prior to cold working, by which thermal treatment the material adopts a state of overaging. In the case of aluminium-lithium alloys it has not been possible subsequent to hot working, intermediate annealing, cold working and recrystallization to reproducibly achieve such properties in which fatigue cracks extend normal to the principal normal stresses. Rather, it has been found that fatigue cracks deviate in various ways from the crack propagation path which extends normal to the principal normal stresses, and that deviations of up to 70° may occur. Moreover, when such a thermomechanical process is employed the disadvantage of poor cold-workability has resulted which is marked by a strong tendency towards the formation of edge cracks. The spectrum of applicable process parameters is greatly limited thereby.

The invention is based on the object of improving the manufacture of sheet metal with simple means so that it will also be possible in the case of aluminium-lithium alloys to achieve sufficient isotropy of the manufactured sheets in which fatigue cracks extend substantially normal to the applied principal normal stresses. It is also desirable to achieve good cold-workability.

In summary, the invention is directed to a process of manufacturing aluminum sheets of thickness ranging from about 0.5 to 10 mm from aluminum alloys. The process comprises the steps of:

(a) shaping a bar made from said aluminum alloy into a sheet, strip or other similar semifinished product;
(b) subjecting said semifinished product to solution heat treatment;
(c) quenching said solution heat-treated semifinished product;
(d) forming said quenched product at a reduction of between about 2% to 60%;
(e) subjecting the annealed semifinished product to intermediate annealing in a temperature range of between about 250° C. to 475° C. for a period of 1–85 hours;
(f) subjecting the annealed semifinished product to cold working at a reduction between about 40% to 80%;

(g) solution heat treating the cold worked semifinished product at a temperature at which recrystallization occurs;
(h) quenching said solution-treated semifinished product;
(i) working said quenched semifinished product at a reduction of up to about 8% to provide a finished product; and
(j) aging said finished product.

Type AlLi 8090 aluminium alloys having the following composition are especially preferred:

| | |
|---|---|
| lithium: | 2.2–2.7% (by weight) |
| copper: | 1.0–1.6% |
| magnesium: | 0.6–1.3% |
| zirconium: | 0.04–0.16% |
| iron: | ≦0.3% |
| silicon: | ≦0.2% |
| chromium: | ≦0.1% |
| manganese: | ≦0.1% |
| titanium: | ≦0.1% |
| zinc: | ≦0.25% |
| other ingredients individually: | ≦0.05% |
| total of other ingredients: | ≦0.15% |
| balance aluminium | |

The solution heat treatment is performed within a temperature range of from 500° C. to 550° C. and preferentially for a time period of t=10 min up to 2 h. Quenching is performed at quenching rates of ≧300° C./min.

Intermediate annealing of the semifinished material is performed in accordance with the instant invention within a temperature range of from 250° to 475° C. for a period of from 1–85 h, while working of the recrystallized semifinished material is performed especially as a cold-working step with an amount of deformation of only up to 8%, especially up to 5% and preferentially only up to 3.5%. In this connection it is recommended chiefly to perform stretching and/or stretch-forming, i.e. rolling should be avoided.

The first forming stage prior to intermediate annealing is appropriately conducted at a low amount of deformation of from 5% to 20%, while the second forming stage, i.e. cold working subsequent to intermediate annealing, is conducted at a high degree of cold working, e.g. cold rolling of from 40% and 90%.

The intermediate thermal treatment (intermediate annealing) is appropriately performed so that the formed material is initially held at an intermediate annealing temperature which corresponds to one of the following two formulae:

$$T \leqq (78 - KW_2) \cdot 6 + 360 \quad (1)$$

$$(KW_2 - 78) \cdot 7 + 300 \leqq T \leqq (78 - KW_2) \cdot 2.35 + 340 \quad (2)$$

The temperature is measured in °C. and the amount of cold forming ($KW_2$) (subsequent to intermediate annealing) is measured in percent (based on the initial thickness of the material).

The material is maintained at approximately this holding temperature for a period of between 1 and 85 hours. Thereafter the material is preferentially cooled at a cooling rate of not more than 40° /h down to the temperature range of from 325° to 275° C.

In another preferred embodiment the material during intermediate annealing, after having been held at the intermediate annealing temperature, is cooled at a cooling rate of V>300° /min and subsequently cold-formed. In this case the following relationship $$t \geqq 8 \cdot e^{15,000(1/T - 1/670)} \quad (3)$$

should appropriately be observed between the holding time t at the holding temperature and the target holding temperature T; t is the holding time in terms of hours and T is the holding temperature in terms of °K.

Especially preferred final sheet thicknesses are between 1 and 9 mm.

The process steps g, h and i disclosed herein, i.e. solution heat treatment, quenching of the solution heat treated semifinished material, and forming of the quenched semifinished material, may also be repeated, either as a whole or with partial steps being arbitrarily omitted.

It has been found that the sheets which have been produced in accordance with the instant invention by using the alloy AlLi 8090 and which have a thickness of from 4 to 7 mm, exhibit fatigue cracks in CT-cuts—through the entire range of fatigue crack propagation—which are macroscopically normal to the applied principal normal stresses. Therefore the material is highly isotropic. Moreover, the process is marked by excellent cold rolling behaviour of the semifinished material in the second forming stage, i.e. forming subsequent to intermediate annealing, as compared with the tendency towards edge crack formation.

This will be described in detail with reference to the following examples; the alloys were composed as follows:

| | |
|---|---|
| lithium: | 2.32% (wt. %) |
| copper: | 1.02% |
| magnesium: | 0.77% |
| zirconium: | 0.07% |
| iron: | 0.06% |
| silicon: | 0.036% |
| balance aluminium and unavoidable impurities. | |

EXAMPLE 1

In the following example, the excellent cold-rolling property resulting from the use of the thermomechanical process of the instant invention is to be demonstrated as compared with the conventional thermomechanical treatment.

Table 1 lists examples of thermomechanical treatments which have been conducted.

Table 2 illustrates for these treatments the depth of the occurring edge cracks in dependence on the amount of cold rolling employed as measured during cold rolling subsequent to intermediate annealing.

TABLE 1

| Sample No. | Thermomechanical treatments performed<br>Thermomechanical Treatment | Rem. |
|---|---|---|
| TMT1 | HR + TT + CR | 1 |
| TMT2 | HR + SHT + TT + CR | 2 |
| TMT3 | HR + SHT + PW (40%) + TT (300 C/8 h) + CR | 3 |
| TMT4 | HR + SHT + PW (25%) + TT (300 C/8 h) + CR | 3 |
| TMT5 | HR + SHT + PW (15%) + TT (300 C/8 h) + CR | 3 |
| TMT6 | HR + SHT + PW (15%) + TT (350 C/8 h) + CR | 3 |
| TMT7 | HR + SHT + PW (15%) + TT (400 C/8 h) + CR | 3 |
| TMT8 | HR + SHT + PW (15%) + TT (450 C/8 h) + CR | 3 |
| TMT9 | HR + SHT + PW (15%) + TT (300 C/81 h) + CR | 3 |
| TMT10 | HR + SHT + PW (15%) + TT (425 C/8 h + WQ) + CR | 3 |
| TMT11 | HR + SHT + PW (15%) + TT (425 C/1 h) + CR | 3 |
| TMT12 | HR + SHT + PW (15%) + TT (375 C/53 h + WQ) + CR | 3 |

HR = hot rolling
SHT = solution heat treatment
TT (x° C./y h) = intermediate annealing at a holding temperature of x° C. for y hours
PW (z %) = preforming prior to intermediate annealing by z %
CR = cold rolling
1 = conventional thermomechanical treatment
2 = experimental thermomechanical treatment
3 = thermomechanical treatment of the invention

TABLE 2

Edge crack depth on cold rolling in dependence on the degree of cold rolling for the thermomechanical treatments listed in Table 1.

| TMT | Degree of Cold Rolling<br>30% | 40% | 50% | 60% | 70% | 80% | 85% |
|---|---|---|---|---|---|---|---|
| TMT1 | 23 | 55 | 75 | — | — | — | — |
| TMT2 | 0 | 14 | 45 | 78 | — | — | — |
| TMT3 | 0 | 0 | 8 | 15 | 23 | 36 | 42 |
| TMT4 | 0 | 0 | 7 | 16 | 22 | 37 | 45 |
| TMT5 | 0 | 0 | 0 | 14 | 22 | 32 | 40 |
| TMT6 | 0 | 0 | 0 | 11 | 36 | 65 | — |
| TMT7 | 0 | 0 | 0 | 0 | 6 | 27 | 34 |
| TMT8 | 0 | 0 | 0 | 0 | 0 | 9 | 16 |
| TMT9 | 0 | 22 | 22 | 22 | 45 | 61 | * |
| TMT10 | 0 | 0 | 0 | 0 | 0 | 0 | * |
| TMT11 | 0 | 0 | 0 | 16 | 32 | 32 | * |
| TMT12 | 0 | 0 | 0 | 0 | 0 | * | * |

— = sample cracked through completely
x= not measured

EXAMPLE 2

Here, there are results of measurements of fatigue crack propagation for samples produced in accordance with the thermomechanical process of the instant invention as compared with conventionally produced samples (Table 3).

The fatigue crack propagation tests were made with so-called CT-cuts in the propagation direction T-L which is particularly critical as to fatigue crack deviations. The examined range of variation of the stress intensity was $$\Delta K \cdot \epsilon (10 - 33) \text{ MPa} \sqrt{m}.$$

The criterion selected to describe deviations of the fatigue cracks from the desired direction normal to the applied principal normal stress was—in case of a deviation—the angle of the crack front in relation to the vertical to the principal normal stress, measured in degrees.

TABLE 3

Examples of thermomechanical treatments and results of fatigue crack propagation tests.

| Sample No. | Thermomechanical Treatment | (degrees) Crack Path Deviation |
|---|---|---|
| 1 | HR + SHT + PW (15%) + TT (250 C/8 h) + CR (60%) | 4* |
| 2 | HR + SHT + PW (15%) + TT (300 C/8 h) + CR (60%) | 0* |
| 3 | HR + SHT + PW (15%) + TT (325 C/8 h) + CR (60%) | 0* |
| 4 | HR + SHT + PW (15%) + TT (325 C/8 h) + CR (77%) | 0* |
| 5 | HR + SHT + PW (15%) + TT (350 C/8 h) + CR (60%) | 0* |
| 6 | HR + SHT + PW (15%) + TT (375 C/8 h) + CR (77%) | 0* |
| 7 | HR + SHT + PW (15%) + TT (400 C/8 h) + CR (77%) | 0* |
| 8 | HR + SHT + PW (15%) + TT (425 C/8 h) + CR (77%) | 0* |
| 9 | HR + SHT + PW (15%) + TT (450 C/8 h) + CR (77%) | 0* |
| 10 | HR + SHT + PW (15%) + TT (450 C/8 h) + CR (68%) | 0* |
| 11 | HR + SHT + PW (15%) + TT (375 C/8 h + WQ) + CR (60%) | 0* |
| 12 | HR + SHT + PW (15%) + TT (425 C/8 h + WQ) + CR (60%) | 0* |
| 13 | HR + SHT + PW (15%) + TT (425 C/8 h + WQ) + CR (68%) | 0* |
| 14 | HR + SHT + PW (15%) + TT (375 C/53 h + WQ) + (CR 65%) | 0* |
| 15 | HR + TT + CR | 0–37 |

*= according to the invention
= conventional
WQ = quenched

EXAMPLE 3

In the third example, some technological properties of metal sheets produced in accordance with the instant process are compared with metal sheets produced according to conventional thermomechanical processes and with metal sheets produced from conventional alloys.

Table 4 lists examples for the static mechanical properties. Table 5 compares typical crack propagation rates under load in T-L.

Finally, FIGS. 1 to 4 illustrate material textures of sheets produced in accordance with the instant invention from the alloy 8090, compared with sheets produced along conventional thermomechanical lines, based on their <111>pole figures. Whereas the conventional thermomechanical process results in recrystallized sheets whose material textures mainly comprise the typical positions W (cube), Ms (brass), Goss and R, the recrystallization texture of the sheets produced in accordance with the process of the invention in the sheet interior mainly comprises the A position and in the sheet exterior the W-BN position (cube/sheet-normal position) in addition to a high background.

TABLE 4

Figure 1:
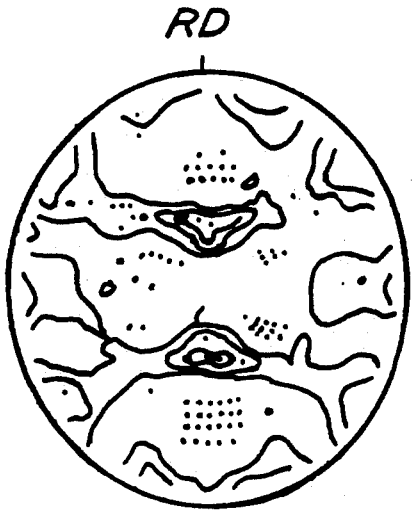
FIGS. 1, 2: (111)pole figures of AlLi 8090 sheets produced by a conventional process: sheet interior FIG. 1, sheet exterior FIG. 1.
Figure 2:
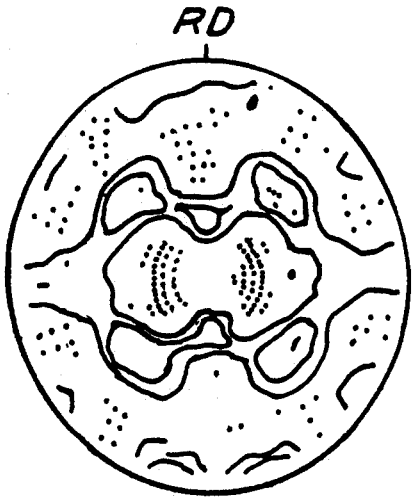
Figure 3:
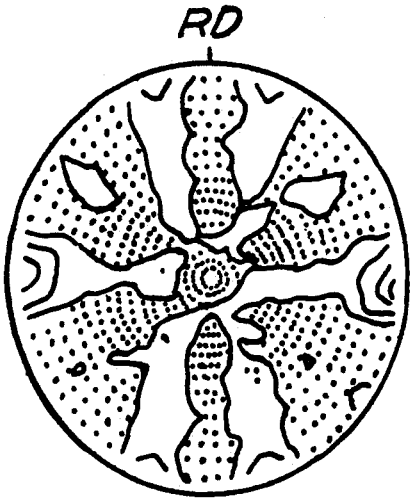
FIGS. 3, 4: (111)pole figures of AlLi 8090 sheets produced by the process of the invention: sheet interior FIG. 3, sheet exterior FIG. 4.
Figure 4:
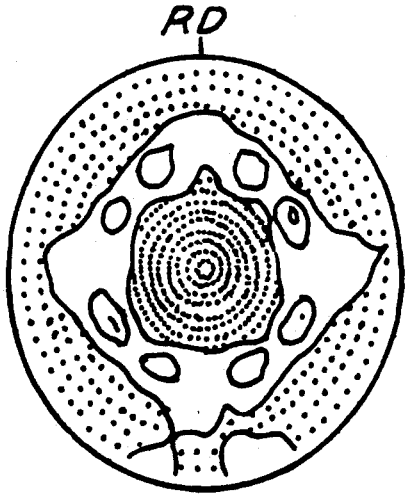

| Sample No. | Typical mechanical properties (MPa) $\sigma_{02}$ | (MPa) $\sigma_{MAX}$ | (%) $\epsilon_8$ |
|---|---|---|---|
| 6 | 308 | 425 | 14.6[1)] |
| 7 | 314 | 427 | 15.4[1)] |
| 8 | 315 | 432 | 14.6[1)] |
| 9 | 310 | 430 | 15.1[1)] |
| 15 | 305–315 | 409–412 | 10.2–10,4[2)] |

[1)]flat bars, thickness × 10, measured length 35 mm, process according to invention
[2)]flat bars, thickness × 12.5, measured length 51 mm, conventional process

TABLE 5

Typical values of crack propagation rate in the fatigue crack propagation test, measured as 0.0001 mm/cycle for sheets produced according to the inventive process as compared with 8090 sheets produced by the conventional thermomechanical process and with the conventional alloys 2024T351 and 7075T351.

| ΔK ($N/mm^{1,5}$) | Alloy Process 8090T851 conventional | 8090T851 invention | 2024T351 | 7075T7351 |
|---|---|---|---|---|
| 400 | $5 \cdot 10^{-1}$ | $5 \cdot 10^{-1}$ | 1.4 | 1.9 |
| 600 | 2 | 2 | 4.5 | 7.1 |
| 800 | 6 | 5 | 12 | 20 |
| 1000 | 14 | 13 | 24 | 50 |

We claim:

1. A process of manufacturing sheets of an aluminum-lithium alloys of thickness between about 0.5 and 10 mm, said process comprising the steps of:

(a) shaping a bar made from said alloy by hot rolling into a sheet, strip or other similar semifinished product;

(b) subjecting said semifinished product to solution heat treatment;

(c) quenching said solution heat-treated semifinished product;

(d) cold rolling the quenched semifinished product at a reduction of between about 2% to 60%;

(e) subjecting the reduced product to intermediate annealing in a temperature range of about 250° to 475° for a period of 1to 85 hours;

(f) subjecting the annealed semifinished product to cold rolling at a reduction between about 40% and 90%;

(g) solution heat treating the cold worked semifinished product at a temperature at which recrystallization occurs;

(h) quenching said solution-treated semifinished product;

(i) working said quenched semifinished product at a reduction of up to about 8% by cold stretching and/or cold stretch-forming to provide a finished product; and (j) aging said finished product.

2. The process as claimed in claim 1, wherein shaping of the bar as set forth in step (a) is performed by hot rolling.

3. The process as claimed in claims 1 and 2, wherein the forming in step (i) is performed by cold stretching and/or cold stretch-forming.

4. The process as claimed in any of the preceding claims, wherein an aluminum-lithium alloy of type AlLi 8090 is processed.

5. The process as claimed in any one of claims 1–4, wherein the forming of the quenched semifinished product in step (d) is performed at a reduction of between about 5% and 20%.

6. The process as claimed in any one of claims 1–5, wherein during intermediate annealing in step (e) at about 300° C., and when the target holding time of at least 60 min has been reached, cooling of the product is performed at a cooling rate of less than about 40°/h down to the temperature range of between about 325° and 275° C.

7. The process as claimed in claim 6, wherein in accordance with step (e) during intermediate annealing, the holding temperature (T in terms of °C.) is selected depending on the degree of cold-forming step (f) following intermediate annealing in accordance with either one of the following two formulae (1) to (2):

$$T \geqq (78 - KW_2) \cdot 6 + 360 \quad (1)$$

$$(KW_2 - 78) \cdot 7 + 300 \leqq T \leqq (78 - KW_2) \cdot 2.35 + 340 \quad (2)$$

8. The process as claimed in any one of claims 1–7, wherein during intermediate annealing in step (e) the following formula (3) is selected for the holding time (t in terms of hours) depending on the holding temperature (T in terms of °K.), and the semifinished product is quenched when the holding time (t) has been reached.

$$t \geqq 8 \cdot e^{15000(1/T - 1/670)}. \quad (3)$$

* * * * *

UNITED STATES PATENT AND TRADEMARK OFFICE

CERTIFICATE OF CORRECTION

PATENT NO. : 5,292,386

DATED : March 8, 1994

INVENTOR(S) : Werner Schelb, et al

It is certified that error appears in the above-identified patent and that said Letters Patent is hereby corrected as shown below:

Claim 7, column 7, line 16, after "cold-forming", insert the following:

--(KW in terms of %) to be performed in cold-forming--.

Signed and Sealed this

Eighth Day of November, 1994

Bruce Lehman

*Attest:*

BRUCE LEHMAN

*Attesting Officer*

*Commissioner of Patents and Trademarks*